US011319893B1

(12) United States Patent
Pursifull et al.

(10) Patent No.: US 11,319,893 B1
(45) Date of Patent: May 3, 2022

(54) METHODS AND SYSTEMS FOR IMPROVING FUEL INJECTION REPEATABILITY

(71) Applicant: Ford Global Technologies, LLC, Dearborn, MI (US)

(72) Inventors: Ross Pursifull, Dearborn, MI (US); Joseph Thomas, Farmington Hills, MI (US); Michael Uhrich, Wixom, MI (US); David Oshinsky, Trenton, MI (US); Rani Kiwan, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/303,085

(22) Filed: May 19, 2021

(51) Int. Cl.
*F02D 41/20* (2006.01)
*F02D 41/24* (2006.01)
*F02D 41/22* (2006.01)

(52) U.S. Cl.
CPC ..... *F02D 41/2467* (2013.01); *F02D 41/20* (2013.01); *F02D 41/2477* (2013.01); *F02D 2041/2027* (2013.01); *F02D 2041/2051* (2013.01); *F02D 2041/2055* (2013.01); *F02D 2041/2058* (2013.01); *F02D 2041/224* (2013.01); *F02D 2200/0602* (2013.01); *F02D 2200/0611* (2013.01); *F02D 2200/0614* (2013.01); *F02D 2200/0616* (2013.01); *F02D 2200/606* (2013.01); *F02D 2200/701* (2013.01)

(58) Field of Classification Search
CPC ..... F02D 41/20; F02D 2041/2027; F02D 2041/2051; F02D 2041/2055; F02D 2041/2058; F02D 2041/224; F02D 2200/0602; F02D 2200/0614; F02D 2200/0616
USPC ..... 701/104; 123/490
See application file for complete search history.

(56) References Cited

U.S. PATENT DOCUMENTS

| | | | | |
|---|---|---|---|---|
| 7,717,088 | B2 * | 5/2010 | Thomas | F02D 41/2438 123/478 |
| 7,806,106 | B2 * | 10/2010 | Cinpinski | F02D 41/3854 123/446 |
| 7,841,319 | B2 | 11/2010 | Thomas | |
| 9,133,787 | B2 | 9/2015 | Pelizzoni et al. | |
| 9,243,598 | B2 | 1/2016 | Pursifull et al. | |
| 9,611,801 | B2 | 4/2017 | Surnilla et al. | |
| 10,731,593 | B2 | 8/2020 | Surnilla et al. | |
| 10,844,804 | B2 | 11/2020 | Pursifull et al. | |
| 10,865,721 | B1 | 12/2020 | Thomas et al. | |
| 10,900,436 | B2 | 1/2021 | Pursifull et al. | |

(Continued)

FOREIGN PATENT DOCUMENTS

WO 2009086039 A2 7/2009

OTHER PUBLICATIONS

Pursifull, R. et al., "System and Method for Injecting Fuel to an Engine," U.S. Appl. No. 17/017,791, filed Sep. 11, 2020, 33 pages.

(Continued)

*Primary Examiner* — Erick R Solis
(74) *Attorney, Agent, or Firm* — Geoffrey Brumbaugh; McCoy Russell LLP

(57) ABSTRACT

Methods and systems are provided for balancing injector fueling. In one example, a method includes learning portions of a transfer function shape by firing a plurality of injectors at PWs of a set of PWs following a reference injection.

19 Claims, 5 Drawing Sheets

(56) References Cited

U.S. PATENT DOCUMENTS

| | | | | |
|---|---|---|---|---|
| 10,934,955 | B2 | 3/2021 | Pursifull et al. | |
| 10,947,923 | B2 | 3/2021 | Pursifull et al. | |
| 10,954,880 | B1 | 3/2021 | Thomas et al. | |
| 10,989,132 | B2 | 4/2021 | Thomas et al. | |
| 11,035,654 | B2 | 6/2021 | McLaren et al. | |
| 2014/0224220 | A1 | 8/2014 | Moonjelly et al. | |
| 2015/0240771 | A1 | 8/2015 | Pursifull et al. | |
| 2020/0116099 | A1* | 4/2020 | Surnilla ..... | F02D 41/0085 |
| 2021/0017928 | A1 | 1/2021 | Thomas et al. | |

OTHER PUBLICATIONS

Pursifull, R. et al., "Method and System for Adjusting Operation of a Fuel Injector," U.S. Appl. No. 17/039,589, filed Sep. 30, 2020, 36 pages.

Kiwan, R. et al., "Method and System for Fuel Injector Balancing," U.S. Appl. No. 17/093,384, filed Nov. 9, 2020, 62 pages.

Pursifull, R. et al., "Method and System for Multiple Injections," U.S. Appl. No. 17/157,849, filed Jan. 25, 2021, 50 pages.

Oshinsky, D. et al., "Methods and Systems for Fuel Injection Control," U.S. Appl. No. 17/198,106, filed Mar. 10, 2021, 55 pages.

Campbell, I. et al., "Methods and Systems for Improving Fuel Injection," U.S. Appl. No. 17/203,606, filed Mar. 16, 2021, 32 pages.

Pursifull, R. et al., "Methods and Systems for Compensating for Fuel Injector Closing Time," U.S. Appl. No. 17/204,254, filed Mar. 17, 2021, 43 pages.

Pursifull, R. et al., "Methods and Systems for Improving Fuel Injection Repeatability," U.S. Appl. No. 17/205,384, filed Mar. 18, 2021, 44 pages.

Kiwan, R. et al., "Methods and Systems for Controlling Fuel Injector Holding Current," U.S. Appl. No. 17/209,014, filed Mar. 22, 2021, 40 pages.

Pursifull, R. et al., "Method and System for Operating a Fuel Injector," U.S. Appl. No. 17/240,165, filed Apr. 26, 2021, 34 pages.

Kiwan, R. et al., "Methods and Systems for Improving Fuel Injection Repeatability," U.S. Appl. No. 17/302,496, filed May 4, 2021, 63 pages.

Kiwan, R. et al., "Methods and Systems for Fuel Injector Balancing," U.S. Appl. No. 17/302,498, filed May 4, 2021, 54 pages.

Pursifull, R. et al., "Methods and Systems for Improving Fuel Injection Repeatability," U.S. Appl. No. 17/303,085, filed May 19, 2021, 43 pages.

Pursifull, R. et al., "Methods and Systems for Improving Fuel Injection Repeatability," U.S. Appl. No. 17/304,721, filed Jun. 24, 2021, 48 pages.

Pursifull, R. et al., "Methods and Systems for Improving Fuel Injection Repeatability," U.S. Appl. No. 17/304,728, filed Jun. 24, 2021, 47 pages.

* cited by examiner

METHODS AND SYSTEMS FOR IMPROVING FUEL INJECTION REPEATABILITY

FIELD

The present description relates generally to systems and methods for improving accuracy of an amount of fuel that is injected to an engine via sensing a fuel rail pressure drop for at least one injector.

BACKGROUND/SUMMARY

An internal combustion engine may include one or more fuel injectors to inject fuel directly into a cylinder, or alternatively, into an intake port of a cylinder. The one or more fuel injectors may be commanded fully open and fully closed via an electric signal. The one or more fuel injectors may provide a fuel flow rate when fully open and the amount of fuel that is injected by the one or more fuel injectors may be controlled via adjusting pressure of fuel that is supplied to the one or more fuel injectors and timing of the electric signal.

Due to manufacturing tolerances and operating conditions experienced by the one or more fuel injectors, an amount of fuel injected by one fuel injector for a given fuel injection command when the fuel injector is new may be a first amount. The amount of fuel that is injected by the fuel injector for the same given fuel injection command when the fuel injector is aged may be a second amount, different than the first, resulting in fueling discrepancies. In addition, an amount of fuel injected by a second fuel injector that is similar to the first fuel injector for the same given fuel injection command may be a third amount, the third amount different than the first amount. Therefore, it would be desirable to provide a way of adjusting operation of a fuel injector so that a fuel injection command delivers a more consistent amount of fuel injected through each of the injectors.

In one example, the above issue may be addressed by a method for determining a first bulk modulus via injecting a reference injection followed by injections at a first plurality of pulse-widths (PWs) via injectors of one or more cylinders. In this way, a portion of a fuel mass transfer function shape is learned.

As an example, the learning of an overall shape of the fuel mass transfer function shape may be executed locally via injections at a second plurality of PWs. Additionally or alternatively, the learning may be accelerated via retrieving portions of the fuel mass transfer function shape from a cloud storing portions of the fuel mass transfer function shape learned via other vehicles. By doing this, if the learning may not be executed locally due to conditions, then the learning may still be completed via data from the cloud.

The approach described herein may have several advantages. In particular, the approach may reduce an amount of time it takes to learn a fuel injector transfer function or operational relationship. Further, the approach may be applicable to port and direct fuel injectors. In addition, the approach may be performed while a vehicle is operating on a road. The above advantages and other advantages, and features of the present description will be readily apparent from the following detailed description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 3:
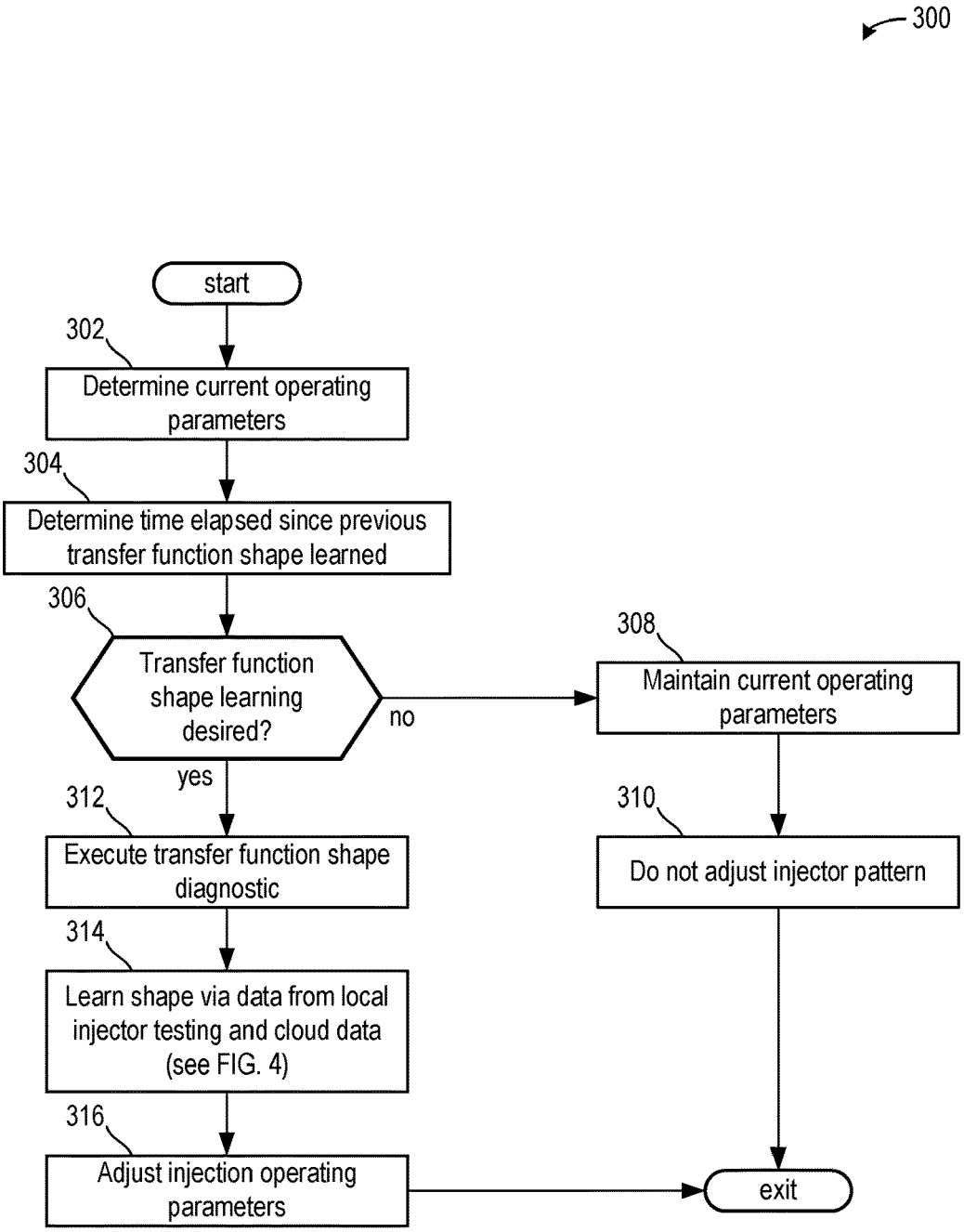
FIG. 3 shows a high level flow chart for learning an injector transfer function shape.
Figure 4:
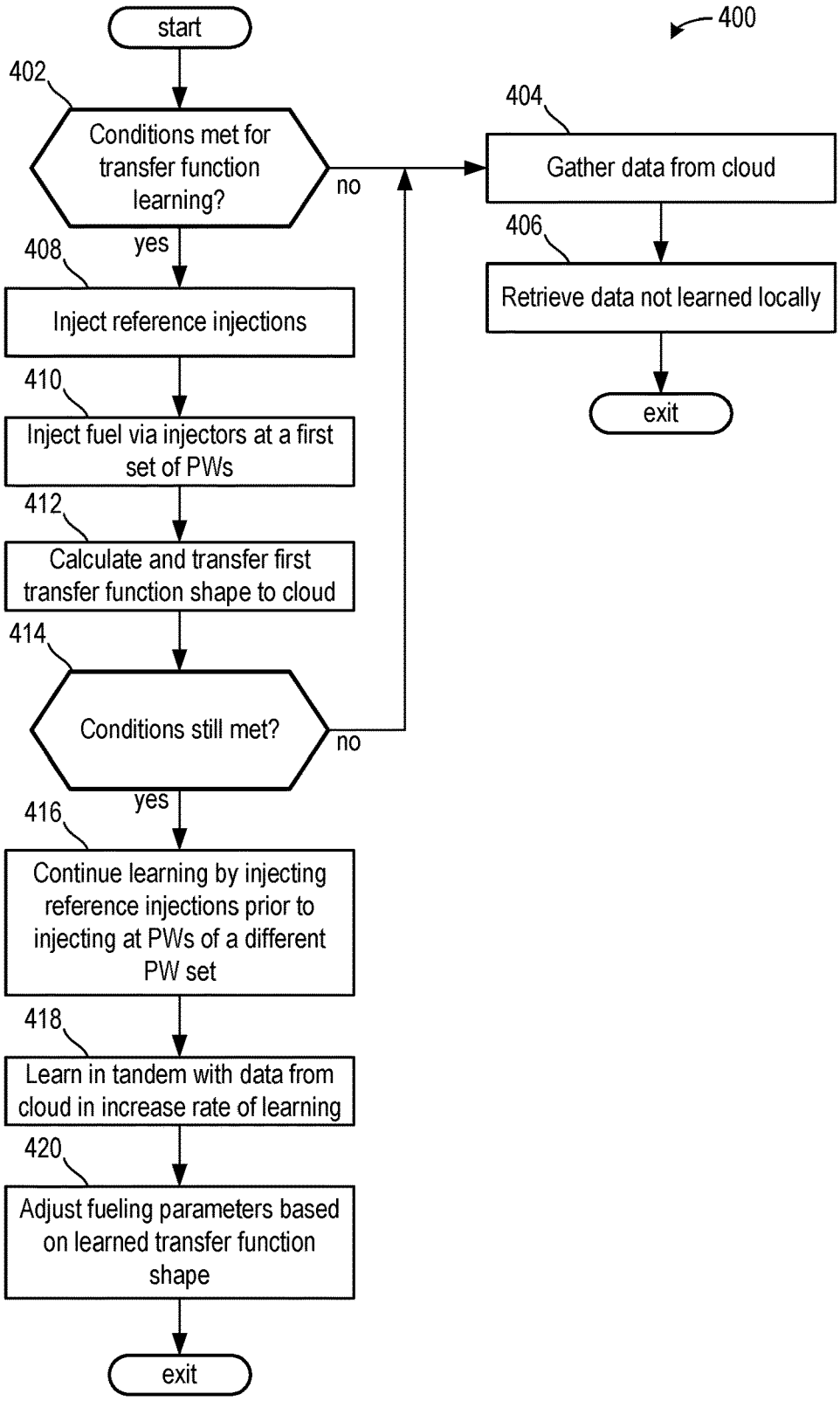
FIG. 4 shows a method for adjusting an injection pattern to learn a portion of the injector transfer function shape.
Figure 5:
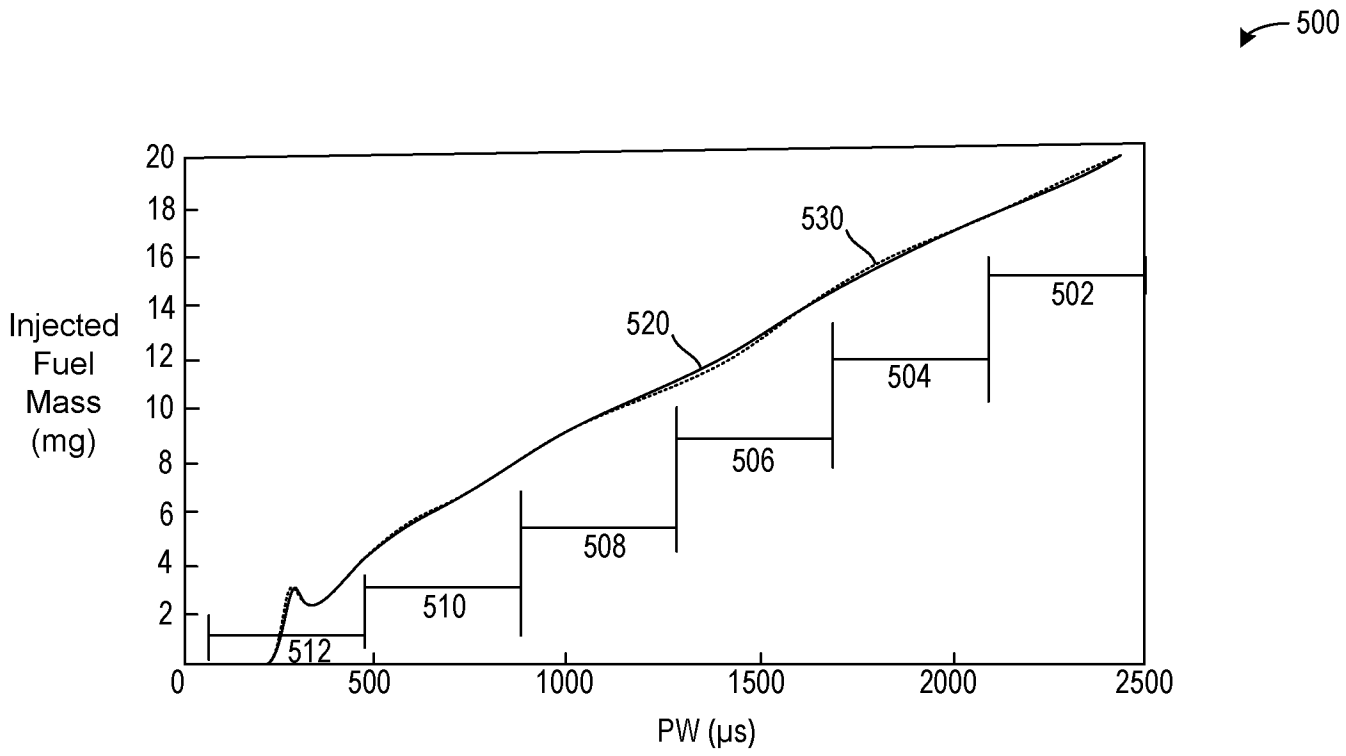
FIG. 5 shows a graph illustrating injector transfer function shapes for each injector of a plurality of injectors of the engine segmented by different sets of PWs to learn different portions of the transfer function shape.

The following description relates to systems and methods for determining a transfer function shape for a plurality of injectors via a pressure-based injector balancing (PBIB) diagnostic. The transfer function shape, which may be substantially identical for a group of similar injectors of an engine, such as the engine of FIG. 1, may be learned. The PBIB diagnostic may learn a drop in FRP for a fuel system, such as the fuel system of FIG. 2. FIG. 3 shows a high level flow chart for learning an injector transfer function shape. FIG. 4 shows a method for adjusting an injection pattern to learn a portion of the injector transfer function shape. FIG. 5 shows a graph illustrating injector transfer function shapes for each injector of a plurality of injectors of the engine segmented by different sets of PWs to learn different portions of the transfer function shape.

Herein, the present disclosure relates to determining an injector transfer function shape. The injector transfer function shape may be interchangeably referred to as a deviation in injected fuel mass shape, an error shape, an injector error shape, or the like. The injector transfer function shape may be utilized during conditions where measurement of an injector current is unavailable, wherein fueling errors are corrected based on the injector transfer function shape, described in greater detail below.

Figure 1:
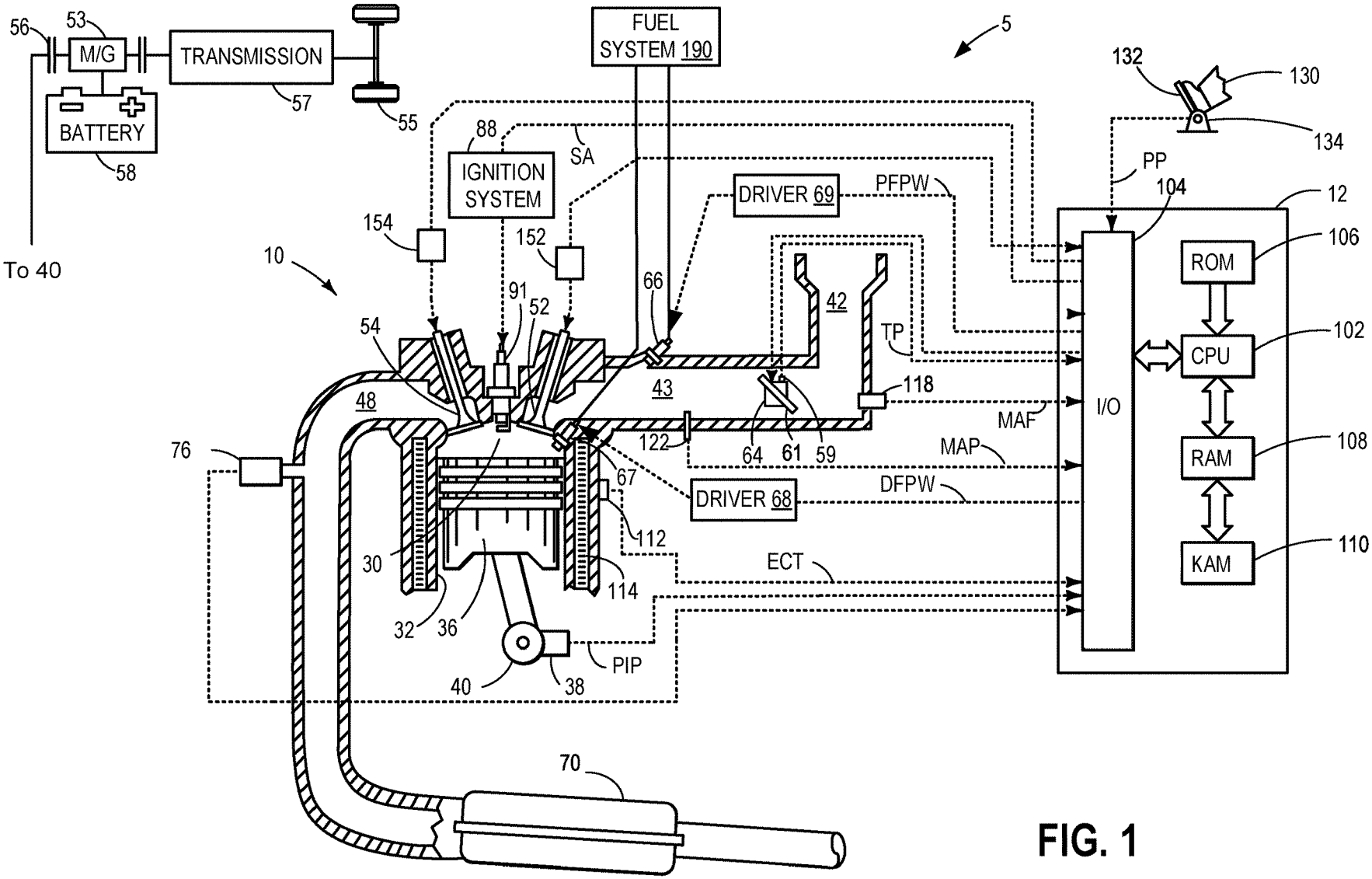
FIG. 1 shows a schematic depiction of an example propulsion system including an engine.
Figure 2:
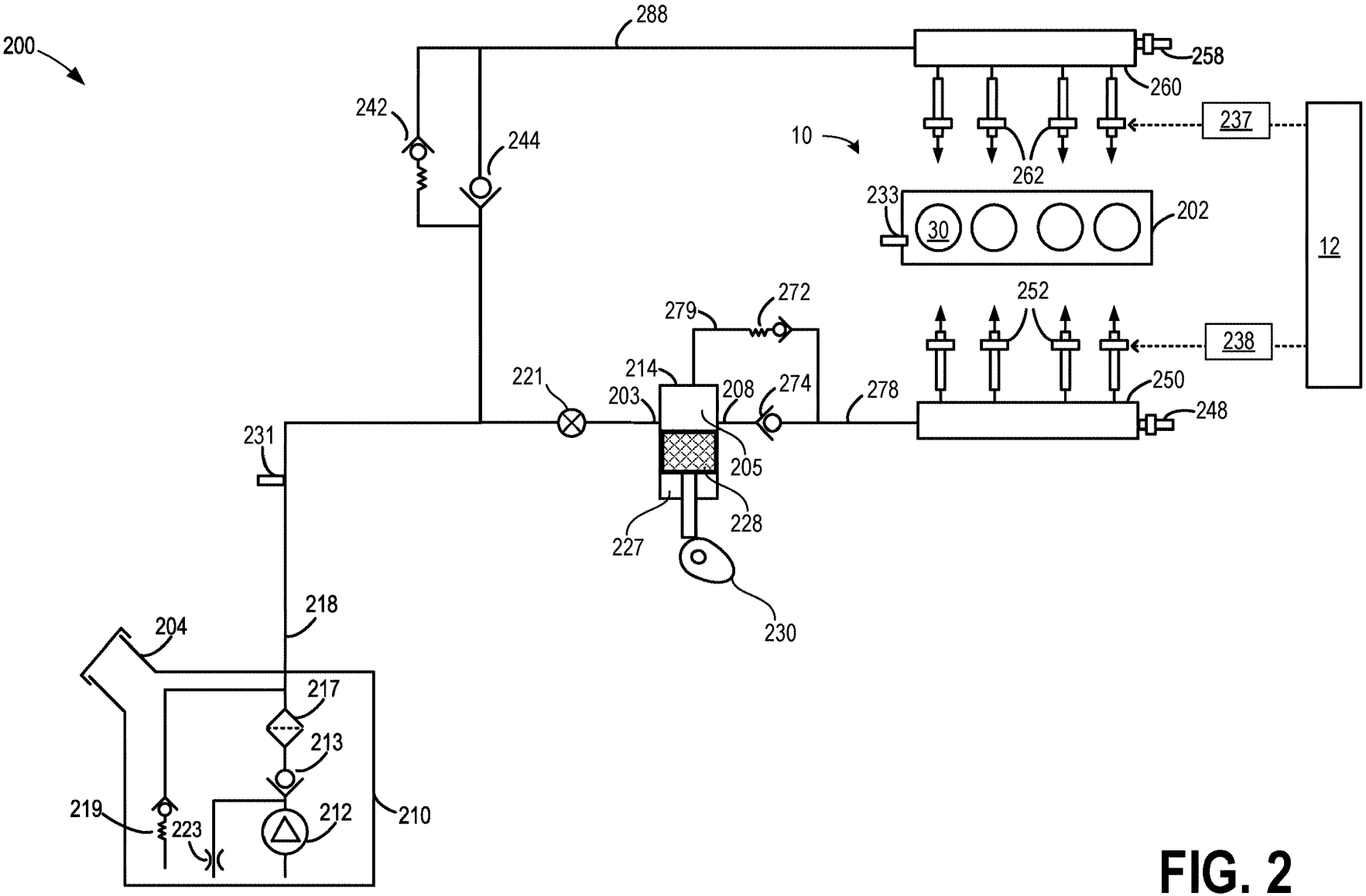
FIG. 2 shows an example fuel system coupled to the engine of FIG. 1.

FIGS. 1-2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 shows a schematic depiction of a spark ignition internal combustion engine 10 with a dual injector system, where engine 10 is configured with both direct injection and port fuel injection. As such, engine 10 may be referred to as a port-fuel direct inject (PFDI) engine. Engine 10 may be included in a vehicle 5. Engine 10 comprises a plurality of cylinders of which one cylinder 30 (also known as combustion chamber 30) is shown in FIG. 1. Cylinder 30 of engine 10 is shown including combustion chamber walls 32 with piston 36 positioned therein and connected to crankshaft 40. A starter motor (not shown) may be coupled to crankshaft 40 via a flywheel (not shown), or alternatively, direct engine starting may be used.

Combustion chamber 30 is shown communicating with intake manifold 43 and exhaust manifold 48 via intake valve 52 and exhaust valve 54, respectively. In addition, intake manifold 43 is shown with throttle 64 which adjusts a position of throttle plate 61 to control airflow from intake passage 42.

Intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

In another embodiment, four valves per cylinder may be used. In still another example, two intake valves and one exhaust valve per cylinder may be used.

Combustion chamber 30 can have a compression ratio, which is the ratio of volumes when piston 36 is at bottom center to top center. In one example, the compression ratio may be approximately 9:1. However, in some examples where different fuels are used, the compression ratio may be increased. For example, it may be between 10:1 and 11:1 or 11:1 and 12:1, or greater.

In some embodiments, each cylinder of engine 10 may be configured with one or more fuel injectors for providing fuel thereto. As shown in FIG. 1, cylinder 30 includes two fuel injectors, 66 and 67. Fuel injector 67 is shown directly coupled to combustion chamber 30 and positioned to directly inject therein in proportion to the pulse width of signal DFPW received from controller 12 via electronic driver 68. In this manner, direct fuel injector 67 provides what is known as direct injection (hereafter referred to as "DI") of fuel into combustion chamber 30. While FIG. 1 shows injector 67 as a side injector, it may also be located overhead of the piston, such as near the position of spark plug 91. Such a position may improve mixing and combustion due to the lower volatility of some alcohol based fuels. Alternatively, the injector may be located overhead and near the intake valve to improve mixing.

Fuel injector 66 is shown arranged in intake manifold 43 in a configuration that provides what is known as port injection of fuel (hereafter referred to as "PFI") into the intake port upstream of cylinder 30 rather than directly into cylinder 30. Port fuel injector 66 delivers injected fuel in proportion to the pulse width of signal PFPW received from controller 12 via electronic driver 69.

Fuel may be delivered to fuel injectors 66 and 67 by a high pressure fuel system 190 including a fuel tank, fuel pumps, and fuel rails. Further, the fuel tank and rails may each have a pressure transducer providing a signal to controller 12. In this example, both direct fuel injector 67 and port fuel injector 66 are shown. However, certain engines may include only one kind of fuel injector such as either direct fuel injector or port fuel injector. Fuel injection to each cylinder may be carried out via direct injectors (in absence of port injectors) or port direct injectors (in absence of direct injectors). An example fuel system including fuel pumps and injectors and fuel rails is elaborated on with reference to FIG. 2.

Returning to FIG. 1, exhaust gases flow through exhaust manifold 48 into emission control device 70 which can include multiple catalyst bricks, in one example. In another example, multiple emission control devices, each with multiple bricks, can be used. Emission control device 70 can be a three-way type catalyst in one example.

Exhaust gas sensor 76 is shown coupled to exhaust manifold 48 upstream of emission control device 70 (where sensor 76 can correspond to a variety of different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS may be used to advantage during feedback air/fuel control to maintain average air/fuel at stoichiometry during a stoichiometric homogeneous mode of operation. A single exhaust gas sensor may serve 1, 2, 3, 4, 5, or other number of cylinders.

Distributorless ignition system 88 provides ignition spark to combustion chamber 30 via spark plug 91 in response to spark advance signal SA from controller 12.

Controller 12 may cause combustion chamber 30 to operate in a variety of combustion modes, including a homogeneous air/fuel mode and a stratified air/fuel mode by controlling injection timing, injection amounts, spray patterns, etc. Further, combined stratified and homogenous mixtures may be formed in the chamber. In one example, stratified layers may be formed by operating injector 67 during a compression stroke. In another example, a homogenous mixture may be formed by operating one or both of injectors 66 and 67 during an intake stroke (which may be open valve injection). In yet another example, a homogenous mixture may be formed by operating one or both of injectors 66 and 67 before an intake stroke (which may be closed valve injection). In still other examples, multiple injections from one or both of injectors 66 and 67 may be used during one or more strokes (e.g., intake, compression, exhaust, etc.). Even further examples may be where different injection timings and mixture formations are used under different conditions, as described below.

Controller 12 can control the amount of fuel delivered by fuel injectors 66 and 67 so that the homogeneous, stratified, or combined homogenous/stratified air/fuel mixture in chamber 30 can be selected to be at stoichiometry, a value rich of stoichiometry, or a value lean of stoichiometry. Further, controller 12 may be configured to adjust a fuel injection pattern of the fuel injectors 66 and 67 during a pressure-based injector balancing (PBIB) diagnostic. The controller 12 may include instructions that when executed cause the controller 12 to adjust an injection pattern to execute reference injections prior to learning a transfer function shape. The reference injections may be used to learn a bulk modulus of the fuel, which may be used to enhance an accuracy of the learned transfer function shape. Bulk modulus is defined as a resistance of a substance to compression.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time. Further, in the disclosed embodiments, an exhaust gas recirculation (EGR) system may be used to route a desired portion of exhaust gas from exhaust manifold 48 to intake manifold 43 via an EGR valve (not shown). Alternatively, a portion of combustion gases may be retained in the combustion chambers by controlling exhaust valve timing.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 53. Electric machine 53 may be a motor or a motor/generator. Crankshaft 40 of engine 10 and electric machine 53 are connected via a transmission 57 to vehicle wheels 55 when one or more clutches 56 are engaged. In the depicted example, a first clutch 56 is provided between crankshaft 40 and electric machine 53, and a second clutch 56 is provided between electric machine 53 and transmission 57. Controller 12 may send a signal to an actuator of each clutch 56 to engage or disengage the clutch, so as to connect or disconnect crankshaft 40 from electric machine 53 and the components connected thereto, and/or connect or disconnect electric machine 53 from transmission 57 and the components connected thereto. Transmission 57 may be a gearbox, a planetary gear system, or another type of transmission. The powertrain may be configured in various manners including as a parallel, a series, or a series-parallel hybrid vehicle.

Electric machine 53 receives electrical power from a traction battery 58 to provide torque to vehicle wheels 55. Electric machine 53 may also be operated as a generator to provide electrical power to charge battery 58, for example during a braking operation.

Controller 12 is shown in FIG. 1 as a conventional microcomputer including: central processing unit (CPU) 102, input/output (I/O) ports 104, read-only memory (ROM) 106, random access memory (RAM) 108, keep alive memory (KAM) 110, and a conventional data bus. Controller 12 is shown receiving various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 coupled to crankshaft 40; and throttle position TP from throttle position sensor 59 and an absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 38, which is also used as an engine speed sensor, produces a predetermined number of equally spaced pulses every revolution of the crankshaft. The controller 12 receives signals from the various sensors of FIG. 1 and employs the various actuators of FIG. 1, such as throttle 64, fuel injectors 66 and 67, spark plug 91, etc., to adjust engine operation based on the received signals and instructions stored on a memory of the controller. As one example, the controller may send a pulse width signal to the port injector and/or the direct injector to adjust a timing of fuel injection and an amount of fuel delivered to a cylinder via an injector.

Controller 12 may be communicatively coupled to other vehicles or infrastructures using appropriate communications technology, as is known in the art. For example, controller 12 may be coupled to other vehicles or infrastructures via a wireless network, which may comprise Wi-Fi, Bluetooth, a type of cellular service, a wireless data transfer protocol, and so on. Controller 12 may broadcast (and receive) information regarding vehicle data, vehicle diagnostics, traffic conditions, vehicle location information, vehicle operating procedures, etc., via vehicle-to-vehicle (V2V), vehicle-to-infrastructure-to-vehicle (V2I2V), and/or vehicle-to-infrastructure (V2I or V2X) technology. The communication and the information exchanged between vehicles can be either direct between vehicles, or can be multi-hop. In some examples, longer range communications (e.g. WiMax) may be used in place of, or in conjunction with, V2V, or V2I2V, to extend the coverage area by a few miles. In still other examples, controller 12 may be communicatively coupled to other vehicles or infrastructures via a wireless network and the internet (e.g. cloud), as is commonly known in the art. One example of a V2V communication device may include dedicated-short-range-communication (DSRC) network which may allow vehicles within a threshold proximity (e.g., 5,000 feet) to communicate (e.g., transfer information) free of an internet connection.

Vehicle 5 may also include an on-board navigation system (for example, a Global Positioning System) that an operator of the vehicle may interact with. The navigation system may include one or more location sensors for assisting in estimating vehicle speed, vehicle altitude, vehicle position/location, etc. This information may be used to infer engine operating parameters, such as local barometric pressure. As discussed above, controller 12 may further be configured to receive information via the internet or other communication networks. Information received from the GPS may be cross-referenced to information available via the internet to determine local weather conditions, local vehicle regulations, etc.

FIG. 2 schematically depicts an example embodiment 200 of a fuel system, such as fuel system 190 of FIG. 1. Fuel system 200 may be operated to deliver fuel to an engine, such as engine 10 of FIG. 1. Fuel system 200 may be operated by a controller to perform some or all of the operations described with reference to the methods of FIGS. 4 and 5. Components previously introduced are similarly numbered in FIG. 2. Engine 10 is shown with cylinder 30 arranged in a cylinder bank 202. The cylinder bank 202 may be one of a plurality of cylinder banks of the engine 10, each of the banks identical in configuration.

Fuel system 200 includes a fuel storage tank 210 for storing the fuel on-board the vehicle, a lower pressure fuel pump (LPP) 212 (herein also referred to as fuel lift pump 212), and a higher pressure fuel pump (HPP) 214 (herein also referred to as fuel injection pump 214). Fuel may be provided to fuel tank 210 via fuel filling passage 204. In one example, LPP 212 may be an electrically-powered lower pressure fuel pump disposed at least partially within fuel tank 210. LPP 212 may be operated by a controller 12 (e.g., controller 12 of FIG. 1) to provide fuel to HPP 214 via fuel passage 218. LPP 212 can be configured as what may be referred to as a fuel lift pump. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

LPP 212 may be fluidly coupled to a filter 217, which may remove small impurities contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example, the set-point may be 6.4 bar or 5 bar (g). An orifice 223 may be utilized to allow for air and/or fuel vapor to bleed out of the lift pump 212. This bleed at orifice 223 may also be used to power a jet pump used to transfer fuel from one location to another within the tank 210. In one example, an orifice check valve (not shown) may be placed in series with orifice 223. In some embodiments, fuel system 200 may include one or more (e.g., a series) of check valves fluidly coupled to low-pressure fuel pump 212 to impede fuel from leaking back upstream of the valves. In this context, upstream flow refers to fuel flow traveling from fuel rails 250, 260 towards LPP 212 while downstream flow refers to the nominal fuel flow direction from the LPP towards the HPP 214 and thereon to the fuel rails.

Fuel lifted by LPP 212 may be supplied at a lower pressure into a fuel passage 218 leading to an inlet 203 of HPP 214. HPP 214 may then deliver fuel into a first fuel rail 250 coupled to one or more fuel injectors of a first group of direct injectors 252 (herein also referred to as a plurality of first injectors). Fuel lifted by the LPP 212 may also be supplied to a second fuel rail 260 coupled to one or more fuel injectors of a second group of port injectors 262 (herein also referred to as a plurality of second injectors). HPP 214 may be operated to raise the pressure of fuel delivered to the first fuel rail above the lift pump pressure, with the first fuel rail coupled to the direct injector group operating with a high pressure. As a result, high pressure DI may be enabled while PFI may be operated at a lower pressure.

While each of first fuel rail 250 and second fuel rail 260 are shown dispensing fuel to four fuel injectors of the respective pluralities of first and second injectors 252, 262, it will be appreciated that each fuel rail 250, 260 may dispense fuel to any suitable number of fuel injectors. As one example, first fuel rail 250 may dispense fuel to one fuel injector of plurality of first injectors 252 for each cylinder of the engine while second fuel rail 260 may dispense fuel to one fuel injector of the plurality of second injectors 262 for each cylinder of the engine. Controller 12 can individually actuate each of the plurality of second injectors 262 via a port injection driver 237 and actuate each of the plurality of first injectors 252 via a direct injection driver 238. The controller 12, the drivers 237, 238 and other suitable engine system controllers can comprise a control system. While the drivers 237, 238 are shown external to the controller 12, it should be appreciated that in other examples, the controller 12 can include the drivers 237, 238 or can be configured to provide the functionality of the drivers 237, 238.

HPP 214 may be an engine-driven, positive-displacement pump. As one non-limiting example, HPP 214 may be a Bosch HDP5 high pressure pump, which utilizes a solenoid activated control valve (e.g., fuel volume regulator, magnetic solenoid valve, etc.) to vary the effective pump volume of each pump stroke. The outlet check valve of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump.

A lift pump fuel pressure sensor 231 may be positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212.

First fuel rail 250 includes a first fuel rail pressure sensor 248 for providing an indication of direct injection fuel rail pressure to the controller 12. Likewise, second fuel rail 260 includes a second fuel rail pressure sensor 258 for providing an indication of port injection fuel rail pressure to the controller 12. An engine speed sensor 233 (or an engine angular position sensor from which speed is deduced) can be used to provide an indication of engine speed to the controller 12. The indication of engine speed can be used to identify the speed of higher pressure fuel pump 214, since the pump 214 is mechanically driven by the engine, for example, via the crankshaft or camshaft. A solenoid controlled valve 221 may be included on the inlet side of pump 214. This solenoid controlled valve 221 may have two positions, a first pass through position and a second checked position. In the pass through position, no net pumping into the fuel rail 250 occurs. In the checked position, pumping occurs on the compression stroke of plunger/piston 228. This solenoid valve 221 is synchronously controlled with its drive cam to modulate the fuel quantity pumped into fuel rail 260.

First fuel rail 250 is coupled to an outlet 208 of HPP 214 along fuel passage 278. A check valve 274 and a pressure relief valve (also known as pump relief valve) 272 may be positioned between the outlet 208 of the HPP 214 and the first (DI) fuel rail 250. The pump relief valve 272 may be coupled to a bypass passage 279 of the fuel passage 278. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. The pump relief valve 272 may limit the pressure in fuel passage 278, downstream of HPP 214 and upstream of first fuel rail 250. For example, pump relief valve 272 may limit the pressure in fuel passage 278 to 200 bar. Pump relief valve 272 allows fuel flow out of the DI fuel rail 250 toward pump outlet 208 when the fuel rail pressure is greater than a predetermined pressure. Valves 244 and 242 work in conjunction to keep the low pressure fuel rail 260 pressurized to a pre-determined low pressure. Pressure relief valve 242 helps limit the pressure that can build in fuel rail 260 due to thermal expansion of fuel.

Based on engine operating conditions, fuel may be delivered by one or more of the pluralities of first and second injectors 252, 262. For example, during high load conditions, fuel may be delivered to a cylinder on a given engine cycle via only direct injection, wherein port injectors 262 are disabled (e.g., not injecting fuel). In another example, during mid-load conditions, fuel may be delivered to a cylinder on a given engine cycle via each of direct and port injection. As still another example, during low load conditions, engine starts, as well as warm idling conditions, fuel may be delivered to a cylinder on a given engine cycle via only port injection, wherein direct injectors 252 are disabled.

It is noted here that the high pressure pump 214 of FIG. 2 is presented as an illustrative example of one possible configuration for a high pressure pump. Components shown in FIG. 2 may be removed and/or changed while additional components not presently shown may be added to pump 214 while still maintaining the ability to deliver high-pressure fuel to a direct injection fuel rail and a port injection fuel rail.

Controller 12 can also control the operation of each of fuel pumps 212 and 214 to adjust an amount, pressure, flow rate, etc., of a fuel delivered to the engine. As one example, controller 12 can vary a pressure setting, a pump stroke amount, a pump duty cycle command, and/or fuel flow rate of the fuel pumps to deliver fuel to different locations of the fuel system. A driver (not shown) electronically coupled to controller 12 may be used to send a control signal to the low pressure pump, as required, to adjust the output (e.g., speed, flow output, and/or pressure) of the low pressure pump.

The fuel injectors may have injector-to-injector variability due to manufacturing, as well as due to age. Ideally, for improved fuel economy, injector balancing is desired wherein every cylinder has matching fuel injection amounts for matching fuel delivery commands. By balancing air and fuel injection into all cylinders, engine performance is improved. In particular, fuel injection balancing improves exhaust emission control via effects on exhaust catalyst operation. In addition, fuel injection balancing improves fuel economy because fueling richer or leaner than desired reduces fuel economy and results in an inappropriate ignition timing for the actual fuel-air ratio (relative to the desired ratio). Thus, getting to the intended relative fuel-air ratio has both a primary and secondary effect on maximizing the cylinder energy for the fuel investment.

Fueling errors can have various causes in addition to injector-to-injector variability. These include cylinder-to-cylinder misdistribution, shot-to-shot variation, and transient effects. In the case of injector-to-injector variability, each injector may include a different error between what is commanded to be dispensed and what is actually dispensed. As such, fuel injector balancing may result in an engine's torque evenness. Air and fuel evenness improves emission control.

In one example, during a PBIB diagnostic, one of the plurality of first injectors 252 or the plurality of second injectors 262 may be monitored. In one example, if the plurality of first injectors 252 is being balanced during the PBIB diagnostic, then the pump 214 may be sealed from the first fuel rail 250. Sealing the pump 214 from the first fuel rail 250 may include deactivating the pump 214, closing a valve, or the like. The PBIB diagnostic may further include adjusting an injection timing of the injectors such that injection overlap does not occur. Additionally or alternatively, an inter-injection period, which corresponds to a period of time between sequential injections, may meet a threshold duration, which may be based on a non-zero, positive number. The FRP of the inter-injection period between injections of the same-cylinder bank may be learned by the controller and used to adjust an injector to injector variability. In some examples, FRPs of different cylinder banks may be learned, which may then be cumulatively used to correct injector to injector variability across multiple banks or a single bank of the engine.

During balancing of the amount of fuel injected by a plurality of fuel injectors, a first fuel mass error of a second fuel injector may be estimated based on each of an estimated average fuel rail pressure during an inter-injection period between fuel injection by a first fuel injector and fuel injection by the second fuel injector and an estimated average fuel rail pressure during another inter-injection period between the fuel injection by the second fuel injector and fuel injection by a third fuel injector. Subsequent engine fueling may be adjusted based on the learned fuel mass errors.

In one example, a method may be executed in combination with the systems of FIGS. 1 and 2. The method may include adjusting a fuel injection pattern during a fuel injector diagnostic. The fuel injector diagnostic may be initiated via reference injections. The reference injections may be executed at a single PW for each of the injectors. The reference injections may be followed by injections at a plurality of PWs for a set of PWs. A portion of a transfer function shape may be learned from the set of PWs and a remaining portion of the transfer function shape may be learned locally by injecting the injectors at a plurality of PWs of a different set of PWs or via data from a cloud. Data from the cloud may be gathered from other vehicles similar to a vehicle locally executing the fuel injector diagnostic. Similarities may be based on one or more of a vehicle service history, a vehicle location, a driver behavior, a vehicle make, a vehicle model, a vehicle operator sex, a vehicle operator age, a vehicle operator home address, and a fuel type consumed. In this way, the diagnostic may be executed only locally, only via data from the cloud, or a combination of local assessments and data from the cloud.

Turning now to FIG. 3, it shows a high-level flow chart of a method 300 for learning an injector transfer function shape. Instructions for carrying out method 300 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

The method 300 begins at 302, which includes determining current operating parameters. Current operating parameters may include but are not limited to manifold vacuum, throttle position, engine speed, engine temperature, vehicle speed, and air/fuel ratio.

The method 300 may proceed to 304, which includes determining a time elapsed since a previous transfer function shape was learned. The time elapsed may be tracked via a timer or other time capture device. Additionally or alternatively, a time stamp may be recorded with the previous transfer function shape learned.

The method 300 may proceed to 306, which includes determining if it is desired to learn a transfer function shape. If the time elapsed since the previous transfer function shape was learned is greater than a threshold time elapsed, then learning the transfer function shape may be desired. In one example, the threshold time elapsed is based on a non-zero, positive number. For example, the threshold time elapsed may be between 50 to 200 seconds. In one example, the threshold time elapsed is 100 seconds.

If it is not desired to learn the transfer function shape, then the method 300 may proceed to 308, which includes maintaining current operating parameters.

The method 300 may proceed to 310, which includes not adjusting an injection pattern to execute the injector diagnostic. As such, reference injections may not be injected. Furthermore, injections at PWs corresponding to different PW sets for the diagnostic may not be executed.

Returning to 306, if it is desired to learn the transfer function shape, then the method 300 may proceed to 312, which includes executing a transfer function shape diagnostic.

The method 300 may proceed to 314, which includes learning the transfer function shape via data from local injector testing and cloud data. Local injector testing may include where injectors of a vehicle are fired at a desired injection pattern with desired PWs of various sets of PWs to learn portions of the transfer function shape. The different portions may be combined to determine an overall transfer function shape. In some examples, the locally gathered data (e.g., without communicating with the cloud or other vehicles) may be combined with data from the cloud to more quickly determine the overall transfer function shape. As such, portions of the transfer function shape may be learned locally and via data from the cloud.

The method 300 may proceed to 316, which includes adjusting injection operating parameters. In one example, the injection operating parameters may be adjusted based on a difference between the overall transfer function shape and a desired transfer function shape. In one example, the transfer function shape is based on an actual amount of fuel injected and the desired transfer function shape is based on a commanded amount of fuel to be injected. Thus, as the difference increases, a magnitude of the adjustments may also increase. For example, if the difference between the overall transfer function shape and the desired transfer function shape corresponds to injectors under-fueling (e.g., injecting less fuel than desired) at a specific PW, then an adjustment at the PW may include advancing an injector opening time, increasing an injector opening rate, and/or increasing the PW for the corresponding commanded amount of fuel.

Turning now to FIG. 4, it shows a method 400 for learning the transfer function shape. As described above, the transfer function shape may be learned locally and via data from a cloud. In some example, the reference injections and injections at various sets of PWs may be executed periodically, independent of a desire to learn the transfer function shape. By doing this, the cloud may continuously receive updated data, which may be relayed to other vehicles, thereby decreasing transfer function learning times while also increase a robustness of the learning due to an increased number of injections being used to learn each portion of the transfer function shape.

The method 400 begins at 402, which includes determining if conditions are met for transfer function learning. In one example, conditions for the transfer function learning may include where fueling is desired. Thus, if combustion is desired, then the transfer function learning may be executed. Conditions where transfer function learning may not be executed may include conditions where fueling is not desired, such as during a start/stop, a coasting event, cylinder deactivation events, and the like. In one example, the transfer function learning may be executed during cylinder deactivation events, however, since fewer injectors are included in the diagnostic, the learning may be less accurate relative to learning executed with all injectors.

If conditions for transfer function learning are not met, then the method 400 may proceed to 404, which includes gathering data from a cloud. The cloud may include a processor or other similar logic device and memory, wherein data related to an injector transfer function shape may be saved to the memory. The data may be saved with other information including a vehicle service history, a vehicle location, a driver behavior, a vehicle make, a vehicle model, a vehicle operator sex, a vehicle operator age, a vehicle operator home address, and a fuel type consumed. By categorizing the data in this way, the injector transfer function shape learned may vary between vehicles with different characteristics. For example, a vehicle operated with a more aggressive driver behavior may include a different injector transfer function shape than a vehicle operated with a less aggressive driver behavior.

The method 400 may proceed to 406, which includes retrieving data not learned locally. In one example, the overall transfer function shape may be divided into segments or portions, each portion corresponding to a unique set of PWs. As an example, if the overall transfer function shape is divided into 10 portions, and four of the portions are learned locally, then the other six portions may be retrieved from the cloud. Additionally or alternatively, the four portions learned locally may be sent to the cloud to be relayed to other vehicles. In some examples, additionally or alternatively, the six portions retrieved from the cloud may be learned via other vehicles similar to the local vehicle in one or more of the conditions described above.

Returning to 402, if the conditions for transfer function shape learning are met, then the method 400 may proceed to 408, which includes injecting reference injections. Reference injections may be injected by each injector that will execute injections of a set of PWs. For example, if all cylinders are active and demanding fuel, then each of the port-fuel injectors or direct injectors may inject the reference injection. In one example, transfer function shape learning may be executed with only the port-fuel injectors or the direct injectors. That is to say, the transfer function shape learning for the port-fuel injectors and the direct injectors may not occur simultaneously. In one example, a PW of each of the reference injections may be 1000 μs. Additionally or alternatively, the PW of each of the reference injections may be equal to a PW outside of the set of PWs to be executed during the diagnostic.

Upon injecting the reference injections an actual bulk modulus may be calculated based on the equation below.

$$K_i = \frac{\delta p_i V \rho}{m_{ref}} \tag{1}$$

In equation 1, $K_i$ is an apparent bulk modulus computed for the $i^{th}$ reference injection, $\delta p_i$ is a pressure drop due to the $i^{th}$ injection, V is a fuel rail volume, p is the fuel density, and $m_{ref}$ is the expected fuel mass at the reference PW and current FRP. In the example of equation 1, the apparent bulk modulus is determined for each individual injector. In some examples, an average bulk modulus for all injectors injecting a reference injection may be calculated based on the equation below:

$$K = \frac{1}{n}\sum_{i=1}^{n} K_i \tag{2}$$

Equation 3 below illustrates a combination of equations 1 and 2.

$$K = \frac{\delta p_{total} V \rho}{n \times m_{ref}} \tag{3}$$

$\delta p_{total}$ is equal to a total pressure drop due to all (n) reference injections, and $n \times m_{ref}$ is equal to an expected total mass from all reference injections at the reference PW. Since the current FRP is used to compute the apparent bulk modulus, the computed bulk modulus value is also based on the current FRP. It may be desired to convert the computed bulk modulus value at a reference FRP, which may be done via assuming that bulk modulus changes linearly with pressure, as shown by equation 4 below.

$$K_{@refFRP} = K_{@FRP} S_k(\text{ref}FRP - FRP) \tag{4}$$

The method 400 may proceed to 410, which includes injecting fuel via injectors at a first set of PWs. The first set of PWs may include a plurality of PWs. Each of the plurality of PWs may be equally spaced apart by a common value between 10 to 50 μs. In one example, the difference between each of the plurality of PWs may be spaced apart by 25 μs. The plurality of PWs of the first set of PWs may be within a range, wherein the range may be based on a fixed value (e.g., 200, or 400, or 500, etc.). In some examples, the range may be based on an amount of injections possible based on the PW values. For example, if the first set of PWs includes higher value PWs, such as values about 2000, then the range of the first set of PWs may be lower than a set of PWs with lower value PWs (e.g., below 2000).

In one example, the first set of PWs includes PWs between 2100 to 2500 μs. Thus, each injector may inject at 2500 μs, 2475 μs, 2450 μs, and so on until 2100 μs is reached.

The method 400 may proceed to 412, which includes calculating and transferring a first transfer function shape to the cloud. A first apparent bulk modulus may be calculated for each of the reference injections, wherein the first apparent bulk modulus may be used to determine a first transfer function shape corresponding to PWs of the first set of PWs.

The method 400 may proceed to 414, which includes determining if conditions for learning the transfer function shape are still met. If conditions are not still met, then the method 400 may proceed to 404 as described above. If conditions are still met, then the method 400 may proceed to 416, which includes continuing learning of the transfer function shape by injecting reference injections prior to injecting at PWs of a different PW set. For example, if a second transfer function shape is learned directly following the first transfer function shape, then the method may include injecting a second set of reference injections at a same PW as the reference injections of 408. In one example, the second bulk modulus learned may deviate from the first bulk modulus learned in a stepwise fashion. If this occurs, then the method may include adjusting the transfer function values of one or more of the injections of the first set of PWs.

As one example, the first set of PWs includes 16 PWs between 2125 and 2500. Following learning transfer function values of the first set of PWs and injecting second reference injections for the second set of PWs including 16 PWs between 1725 and 2100, the transfer function values of the first set of PWs may be adjusted based on a change in the bulk modulus over the injections of the first set of PWs. That is to say, if a 4% increase in bulk modulus occurs from the first apparent bulk modulus of the first reference injections to the second apparent bulk modulus of the second reference injections, then the change in bulk modulus may occur across each injection of the 16 PWs. In one example, the transfer function fuel mass at a first PW (e.g., 2500 μs) of the first set of PWs may be unchanged. However, the transfer function fuel mass at a second PW (e.g., 2475 μs) may be adjusted (decreased) by 0.25%, wherein 0.25% is based on equation 5 below.

$$C_{tf} = -\frac{(n-1)\times BM\ \%}{\#\text{ of }PWs} \tag{5}$$

$C_{tf}$ is equal to the percentage adjustment or correction applied to the transfer function, n corresponding to the order of a PW in the PW set (e.g. n=2 for the second PW in the PW set), BM % corresponds to the change in bulk modulus from the start of testing the set of PWs to directly after testing the set of PWs, and # of PWs corresponds to a number of PWs tested between the two sets of reference injections. Thus, the change in bulk modulus is shared across each of the PWs in the set of PWs. An additional adjustment of 0.25% may be added at each PW, such that a transfer function fuel mass at a third PW may be decreased by 0.5%, a transfer function fuel mass at a fourth PW may be decreased by 0.75%, and a transfer function fuel mass at a sixteenth PW of the set may be decreased by 3.75%. If the bulk modulus were to decrease from the first apparent bulk modulus to the second apparent bulk modulus, then the transfer function fuel masses of the first set of PWs would be increased. The difference between the bulk moduli sandwiching a learned PW set may be executed for other PW sets. For example, fuel mass values of the second set may be adjusted based on a bulk modulus change from the second apparent bulk modulus to a third apparent bulk modulus.

In one example, the change in transfer function fuel mass based on the change in bulk modulus may be further divided across individual injectors of plurality of cylinders. For example, the adjustment of 0.25% may be divided by a number of cylinders with injectors that injected at a given PW of the set of PWs. For an 8-cylinder engine, 0.25% may be split by 8, providing a 0.03125% change for each injector of each cylinders. This division may be executed at each PW.

The method 400 may proceed to 418, which includes learning in tandem with data from the cloud to increase a rate of learning. For example, if the first transfer function shape learned locally and a second transfer function shape is available via the cloud, then the method may include skipping to learn a third transfer function shape. Thus, transfer function shapes available via the cloud may be skipped and only transfer function shapes that are unavailable may be learned locally.

The method 400 may proceed to 420, which includes adjusting fueling parameters based on the learned transfer function shape. In one example, adjusting fueling parameters may include adjusting an opening of the injector in response to a difference between the learned transfer function shape and a commanded transfer function shape. If the difference corresponds to an under-fueling, then the fueling parameters may be adjusted to inject more fuel via increasing an amount of time in which the injector is open and/or increasing a rate at which the fuel injector moves to the open position. If the difference corresponds to an over-fueling, then the fueling parameters may be adjusted to inject less fuel via decreasing the amount of time in which the injector is open and/or decreasing the rate at which the fuel injector moves to the open position. By providing these adjustments, balancing between the injectors may be executed, resulting in the injectors injecting a more common amount of fuel.

As described above, the reference injections may be injected periodically such that the transfer function shape is learned based on a period of time. By prophylactically executing the learning in this way, an injector balance may be maintained rather than signaling to learn a transfer function shape in response to a sensed error.

Turning now to FIG. 5, it shows a plot 500 illustrating a single learned transfer function shape 520 for a plurality of injectors. PW is plotted along the abscissa and injected fuel mass is plotted along the ordinate. In one example, the learned transfer function shape 520 is compared to a commanded transfer function shape 530, wherein difference between the two may translate to adjustments to fueling operating parameters. The learned transfer function shape 520 may include a plurality of portions and/or segments, including a first portion 502, a second portion 504, a third portion 506, a fourth portion 508, a fifth portion 510, and a sixth portion 512. In one example, each portion may correspond to a different set of PWs. Thus, the first portion 502 may include a first set of PWs, the second portion 504 may include a second set of PWs, the third portion 506 may include a third set of PWs, the fourth portion 508 may include a fourth set of PWs, the fifth portion 510 may include a fifth set of PWs, and the sixth portion 512 may include a sixth set of PWs. PWs of each of the sets may be different such that the only injections being executed with the same PW are the reference injections.

In one example, a region of the plot 500 includes a ballistic/transition region, which occurs prior to a full valve lift. In one example, the ballistic/transition region corresponds to PWs less than 600 μs, wherein full valve lift may occur outside of the ballistic/transition region. The example of the present disclosure, which accounts for variations in bulk modulus due to real-time driving conditions limiting continuity of injector diagnostic testing, may also account for bulk modulus changes in the ballistic/transition region. Thus, a transfer function shape of the ballistic/transition may be learned.

In this way, balancing fueling across injectors of the engine may occur more rapidly via combining local learning with data from a cloud. By crowdsourcing one or more portions of the injection transfer function shape, the data used to learn the transfer function shape may be more robust, as a greater number of injections are used for each portion of the transfer function shape. The technical effect of combining local and online learning is to increase a rate of learning, which may decrease emissions.

An embodiment of a method, comprises determining a first transfer function shape via injecting a reference injection followed by injections at a first plurality of pulse-widths (PWs) via injectors of one or more cylinders and adjusting fuel injection responsive to the first transfer function shape. A first example of the method further includes determining a second transfer function shape via injecting the reference injection followed by injections at a second plurality of PWs via injectors of one or more cylinders. A second example of the method, optionally including the first example, further includes where a difference between PWs of the first plurality of PWs is between 10 to 50 μs. A third example of the method, optionally including one or more of the previous examples, further includes combining the first transfer function shape with other bulk moduli via repeated local vehicle testing or via gathering other transfer function shapes from a cloud. A fourth example of the method, optionally including one or more of the previous examples, further includes where gathering other transfer function shapes from the cloud includes where other transfer function shapes are calculated via other vehicles similar to a local vehicle on which the first transfer function shape was learned, wherein characteristics for similarity include one or more of a vehicle service history, a vehicle location, a driver behavior, a vehicle make, a vehicle model, a vehicle operator sex, a vehicle operator age, a vehicle operator home address, and a fuel type consumed. A sixth example of the method, optionally including one or more of the previous examples, further includes injectors of one or more cylinders include one or more of direct injectors or port-fuel injectors. A seventh example of the method, optionally including one or more of the previous examples, further includes learning an overall transfer function shape via combining the first transfer function shape with a plurality of transfer function shapes learned locally or retrieved from a cloud, further comprising adjusting injector operating parameters in response to the overall transfer function shape.

An embodiment of a system, comprises an engine including a plurality of cylinders, each of the plurality of cylinders including one or more port-fuel injectors and one or more direct injectors, and a controller with computer-readable instructions stored on non-transitory memory thereof that when executed cause the controller to inject a reference injection, inject a plurality of injections via injectors of either the one or more port-fuel injectors or the one or more direct injectors at different pulse-widths (PWs) of a PW set, and learn a portion of a transfer function shape. A first example of the system further includes where the portion is a first portion, the transfer function shape further comprising a plurality of other portions, wherein the plurality of other portions is learned via local vehicle testing or via data gathered from a cloud, wherein data gather from the cloud is provided via non-local vehicle testing. A second example of the system, optionally including the first example, further includes where the instructions further cause the controller to adjust injection parameters of either the one or more port-fuel injectors or the one or more direct injectors based on the transfer function shape. A third example of the system, optionally including one or more of the previous examples, further includes where the plurality of injections includes injecting an equal number of times for each injector of either the one or more port-fuel injectors or the one or more direct injectors for each cylinder at each PW of the PW set. A fourth example of the system, optionally including one or more of the previous examples, further includes where the reference injection is injected periodically based on a timer, the reference injection is used to learn an apparent bulk modulus prior to learning the transfer function shape. A fifth example of the system, optionally including one or more of the previous examples, further includes where the reference injection is injected by each injector of either the one or more port-fuel injectors or the one or more direct-injectors at a single PW outside of the PW set. A sixth example of the system, optionally including one or more of the previous examples, further includes where a difference between each PW of the PW set is 25 μs. A seventh example of the system, optionally including one or more of the previous examples, further includes where the portion of the transfer function shape is learned for only the one or more port-fuel injectors or the one or more direct-injectors.

A method for operating an engine in a vehicle comprising a controller with instructions stored in memory that cause the controller to execute the method, the method, comprises adjusting an injection pattern for a plurality of injectors following a reference injection, wherein the injection pattern includes injecting each of the plurality of injectors at each pulse-width (PW) of a set of PWs. A first example of the method further includes where the reference injection is injected periodically, and wherein following each reference injection the injection pattern for the plurality of injectors includes a different set of PWs. A second example of the method, optionally including the first example, further includes calculating a bulk modulus based on the reference injection, further comprising determining a transfer function shape of the plurality of injectors for the set of PWs. A third example of the method, optionally including one or more of the previous examples, further includes where comprising adjusting fueling operating conditions in response to a learned overall transfer function shape, wherein adjusting the fueling operating conditions includes adjusting an injector opening timing. A fourth example of the method, optionally including one or more of the previous examples, further includes where learning an overall transfer function shape via combining a portion the transfer function shape learned based on the set of PWs injected in combination with other portions of the transfer function shape learned via data stored on a cloud.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

determining a first transfer function shape via injecting a reference injection followed by injections at a first plurality of pulse-widths (PWs) via injectors of one or more cylinders, where the first transfer function shape is determined based on an apparent bulk modulus, the apparent bulk modulus calculated based on a pressure drop due to the reference injection; and adjusting fuel injection responsive to the first transfer function shape.

2. The method of claim 1, further comprising determining a second transfer function shape via injecting the reference injection followed by injections at a second plurality of PWs via injectors of one or more cylinders.

3. The method of claim 1, wherein a difference between PWs of the first plurality of PWs is between 10 to 50 μs.

4. The method of claim 1, further comprising combining the first transfer function shape with other bulk moduli via repeated local vehicle testing or via gathering other transfer function shapes from a cloud.

5. The method of claim 4, wherein gathering other transfer function shapes from the cloud includes where other transfer function shapes are calculated via other vehicles similar to a local vehicle on which the first transfer function shape was learned, wherein characteristics for similarity include one or more of a vehicle service history, a vehicle location, a driver behavior, a vehicle make, a vehicle model, a vehicle operator sex, a vehicle operator age, a vehicle operator home address, and a fuel type consumed.

6. The method of claim 1, wherein injectors of one or more cylinders include one or more of direct injectors or port-fuel injectors.

7. The method of claim 1, further comprising learning an overall transfer function shape via combining the first transfer function shape with a plurality of transfer function shapes learned locally or retrieved from a cloud, further comprising adjusting injector operating parameters in response to the overall transfer function shape.

8. A system, comprising:

an engine including a plurality of cylinders;

each of the plurality of cylinders including one or more port-fuel injectors and one or more direct injectors; and a controller with computer-readable instructions stored on non-transitory memory thereof that when executed cause the controller to:

inject a reference injection;

inject a plurality of injections via injectors of either the one or more port-fuel injectors or the one or more direct injectors at different pulse-widths (PWs) of a PW set; and learn a portion of a transfer function shape, wherein the plurality of injections includes injecting an equal number of times for each injector of either the one or more port-fuel injectors or the one or more direct injectors for each cylinder at each PW of the PW set.

9. The system of claim 8, wherein the portion is a first portion, the transfer function shape further comprising a plurality of other portions, wherein the plurality of other portions is learned via local vehicle testing or via data gathered from a cloud, wherein data gather from the cloud is provided via non-local vehicle testing.

10. The system of claim 9, wherein the instructions further cause the controller to adjust injection parameters of either the one or more port-fuel injectors or the one or more direct injectors based on the transfer function shape.

11. The system of claim 8, wherein the reference injection is injected periodically based on a timer, the reference injection is used to learn an apparent bulk modulus prior to learning the transfer function shape.

12. The system of claim 8, wherein the reference injection is injected by each injector of either the one or more port-fuel injectors or the one or more direct-injectors at a single PW outside of the PW set.

13. The system of claim 8, wherein a difference between each PW of the PW set is 25 μs.

14. The system of claim 8, wherein the portion of the transfer function shape is learned for only the one or more port-fuel injectors or the one or more direct-injectors.

15. A method for operating an engine in a vehicle comprising a controller with instructions stored in memory that cause the controller to execute the method, the method, comprising:

adjusting an injection pattern for a plurality of injectors following a reference injection, wherein the injection pattern includes injecting each of the plurality of injectors at each pulse-width (PW) of a set of PWs.

16. The method of claim 15, wherein the reference injection is injected periodically, and wherein following each reference injection the injection pattern for the plurality of injectors includes a different set of PWs.

17. The method of claim 15, further comprising calculating a bulk modulus based on the reference injection, further comprising determining a transfer function shape of the plurality of injectors for the set of PWs.

18. The method of claim 17, further comprising adjusting fueling operating conditions in response to a learned overall transfer function shape, wherein adjusting the fueling operating conditions includes adjusting an injector opening timing.

19. The method of claim 15, further comprising learning an overall transfer function shape via combining a portion the transfer function shape learned based on the set of PWs injected in combination with other portions of the transfer function shape learned via data stored on a cloud.

* * * * *